US005890404A

United States Patent [19]

Stojanowski

[11] Patent Number: 5,890,404

[45] Date of Patent: Apr. 6, 1999

[54] RATCHETING ADJUSTABLE WRENCH

[76] Inventor: Thomas Stojanowski, 97 Delafield Pl., Staten Island, N.Y. 10310

[21] Appl. No.: 936,091

[22] Filed: Sep. 23, 1997

[51] Int. Cl.[6] ..... B25B 13/14

[52] U.S. Cl. ..... 81/165; 81/176; 81/158

[58] Field of Search ..... 81/58, 129.5, 126, 81/128, 165–167, 155, 157–158, 173, 175–176, 358, 361, 134–135, 139–140

[56] References Cited

U.S. PATENT DOCUMENTS

| | | | |
|---|---|---|---|
| 1,503,662 | 8/1924 | Norton | 81/165 X |
| 2,562,060 | 7/1951 | Pehrsson | 81/165 X |
| 3,901,106 | 8/1975 | Causey | 81/111 |
| 3,926,077 | 12/1975 | Nordgren | 81/126 |
| 4,825,731 | 5/1989 | Stojanowski | 81/111 |
| 4,848,193 | 7/1989 | Wylie, III | 81/111 |
| 5,018,412 | 5/1991 | Wylie, III | 81/111 |
| 5,297,459 | 3/1994 | Stojanowski | 81/165 |

FOREIGN PATENT DOCUMENTS

| | | | |
|---|---|---|---|
| 2594063 | 8/1987 | France | 81/165 |

*Primary Examiner*—D. S. Meislin
*Attorney, Agent, or Firm*—Richard L. Miller, P.E.

[57] ABSTRACT

A ratcheting adjustable wrench that provides continuous clamping on a nut when rotated in a clockwise direction, while providing ratcheting when rotated in an opposite counterclockwise without having to repeatedly remove it from the nut. The wrench includes a head with a fixed jaw, a movable jaw slidably mounted in the head, a handle pivotally mounted to the head, and a cam component pivotally mounted to the head and operatively connected to the movable jaw and the handle.

2 Claims, 2 Drawing Sheets

FIG. 3
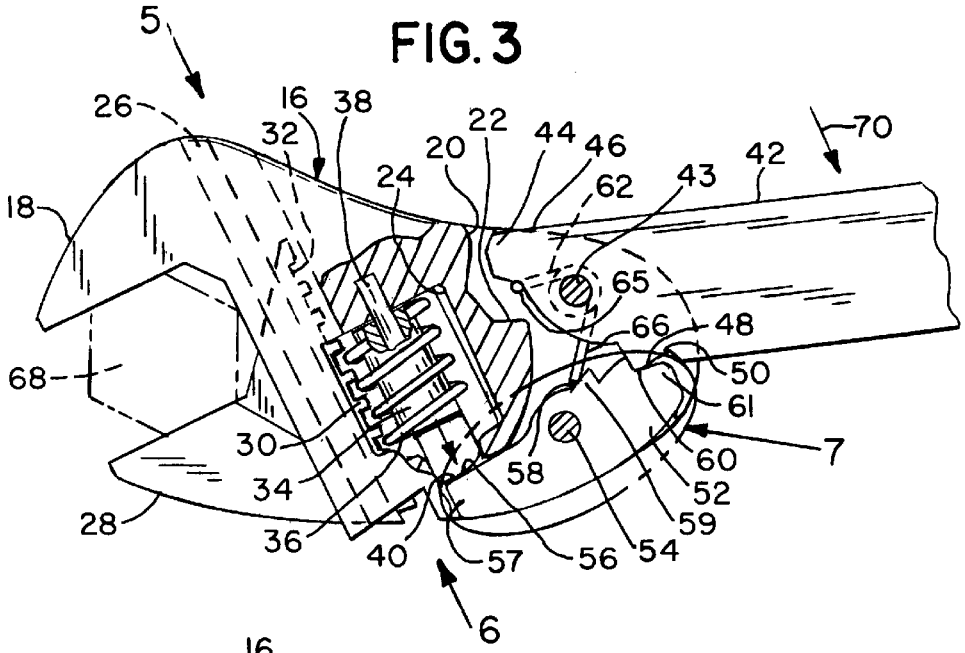
FIG. 5
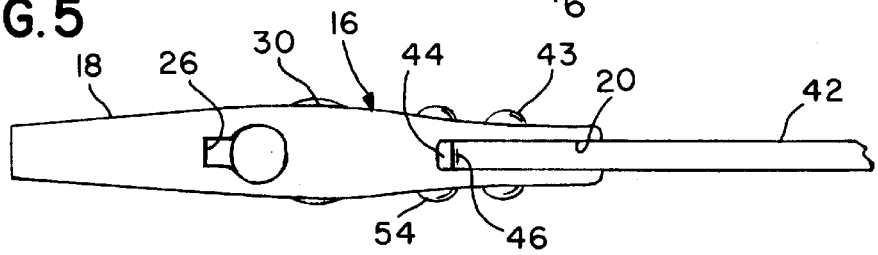
FIG. 6
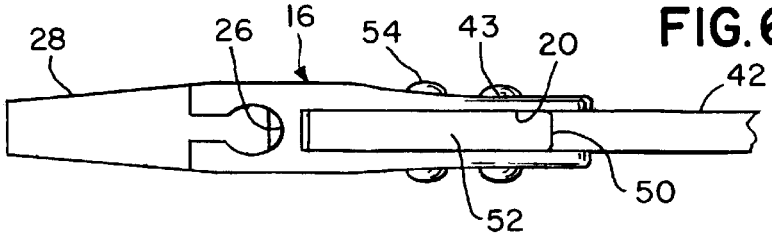
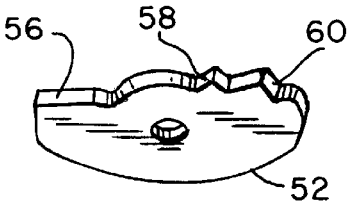
FIG. 7

RATCHETING ADJUSTABLE WRENCH

BACKGROUND OF THE INVENTION

1. Field of the Invention

The present invention relates to an adjustable wrench. More particularly, the present invention relates to a ratcheting adjustable wrench.

2. Description of the Prior Art

Numerous innovations for wrenches have been provided in the prior art that will be described. Even though these innovations may be suitable for the specific individual purposes to which they address, however, they differ from the present invention.

FOR EXAMPLE, U.S. Pat. No. 3,901,106 to Causey teaches an open-end ratchet wrench comprising a wrench handle having integral therewith a jaw and a support portion for a jaw piece movable between locked and open or ratcheting positions. The movable jaw piece has an elongated pivot slot and a substantially L-shaped guide slot engaging pins on the wrench support portion for determining the position of the movable jaw piece relative to the fixed jaw. Spring means are connected between the handle support and the movable jaw piece for normally urging the pivot pin to a rest position in the pivot slot and the guide pin to a locked position in the guide slot thereby normally holding the opposed working surfaces of the fixed jaw and said movable jaw piece in a working relationship gripping opposed surfaces of a nut.

ANOTHER EXAMPLE, U.S. Pat. No. 3,926,077 to Nordgren teaches a combined adjustable spanner and ratchet wrench which when turned in the working direction, the jaws have a firm grip about the work piece and when turned in the return direction, the grip about the work piece is released so that the jaws slide thereabout. The wrench comprises a stem which passes through an opening in a tongue embraced by the legs of a forklike end on the wrench handle, the stem connecting the fork legs and cooperating with the opening to limit the swinging movement of the wrench head and the handle reciprocally. The stem is arranged with the worm in its working position to take a stop position fixed by the edge contour of the opening by bearing on the edge contour.

STILL ANOTHER EXAMPLE, U.S. Pat. No. 4,825,731 to Stojanowski teaches a ratcheting open end wrench designed to be employed in close places to remove nuts and bolts. Primarily, it consists of a handle having a fixed jaw and a pivotal jaw, and the pivotal jaw is provided with an attached arm with a spur that engages with a lip of the handle to prevent over travel of the pivotal jaw.

YET ANOTHER EXAMPLE, U.S. Pat. No. 4,848,193 to Wylie, III teaches an open-end ratchet wrench that includes a handle element, a first jaw portion which is integrally formed with the handle element, a slide portion, a second jaw portion which is integrally formed with the slide portion, a restricting mechanism, and a biasing spring. The slide portion is slidably mounted on the handle element so that the second jaw portion is positionable in a normal position wherein the first and second jaw portions co-operate to define a mouth for receiving the head of a fastening element and the biasing spring biases the second jaw portion toward the normal position thereof. The restricting mechanism maintains the second jaw portion in the normal position thereof when the wrench is manipulated to rotate the head of a fastening element in a first direction so that a turning force is applied to the fastening element. The restricting mechanism, however, permits the second jaw portion to be moved outwardly from the first jaw portion when the wrench is rotated in an opposite second direction so that the head of the fastening element can rotate between the first and second jaw portions.

STILL YET ANOTHER EXAMPLE, U.S. Pat. No. 5,018,412 to Wylie, III teaches an open-end ratchet wrench that includes a handle element, a first jaw portion which is integrally formed with the handle element, a slide portion, a second jaw portion which is integrally formed with the slide portion, a restricting mechanism, and a biasing spring. The slide portion is slidably mounted on the handle element so that the second jaw portion is positionable in a normal position wherein the first and second jaw portions co-operate to define a mouth for receiving the head of a fastening element and the biasing spring biases the second jaw portion toward the normal position thereof. The restricting mechanism maintains the second jaw portion in the normal position thereof when the wrench is manipulated to rotate the head of a fastening element in a first direction so that a turning force is applied to the fastening element. The restricting mechanism, however, permits the second jaw portion to be moved outwardly from the first jaw portion when the wrench is rotated in an opposite second direction so that the head of the fastening element can rotate between the first and second jaw portions.

FINALLY, YET STILL ANOTHER EXAMPLE, U.S. Pat. No. 5,297,459 to Stojanowski teaches a wrench which has a worm gear and mating rack adjustable jaw positioning mechanism for placing a pair of jaws which are adjustable with respect to each other so that they may firmly grip various size nuts, with a mechanism responsive to torque applied in a first direction which causes the jaws to tighten and apply torque to the nut and also responsive to torque applied in a second direction which allows the jaws to separate and rachet to a new position.

It is apparent that numerous innovations for wrenches have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a ratcheting adjustable wrench that avoids the disadvantages of the prior art.

ANOTHER OBJECT of the present invention is to provide a ratcheting adjustable wrench that is simple and inexpensive to manufacture.

STILL ANOTHER OBJECT of the present invention is to provide a ratcheting adjustable wrench that is simple to use.

BRIEFLY STATED, YET ANOTHER OBJECT of the present invention is to provide a ratcheting adjustable wrench that provides continuous clamping on a nut when rotated in a clockwise direction, while providing ratcheting when rotated in an opposite counterclockwise without having to repeatedly remove it from the nut. The wrench includes a head with a fixed jaw, a movable jaw slidably mounted in the head, a handle pivotally mounted to the head, and a cam component pivotally mounted to the head and operatively connected to the movable jaw and the handle.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 3 is a diagrammatic side elevational view, with parts broken away, of the present invention in the area generally enclosed by the dotted ellipse identified by arrow 3 in FIGS. 1 and 2 in the operating position;

FIG. 5 is a diagrammatic top plan view taken generally in the direction of arrow 5 in FIG. 3;

FIG. 6 is a diagrammatic bottom plan view taken generally in the direction of arrow 6 in FIG. 3; and FIG. 7 is a diagrammatic perspective view of the cam component generally enclosed in the dotted ellipse identified by arrow 7 in FIG. 3.

LIST OF REFERENCE NUMERALS UTILIZED IN THE DRAWING

Figure 1:
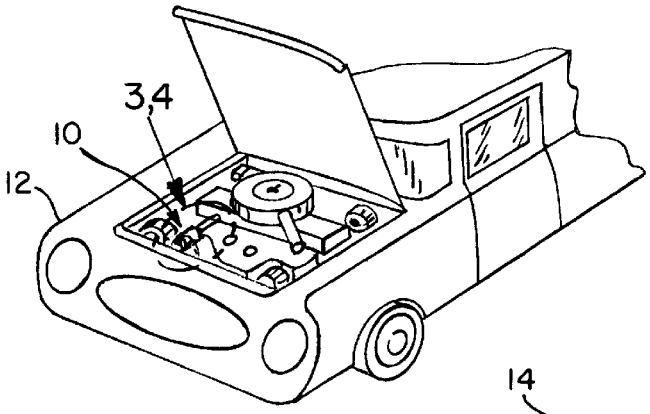
FIG. 1 is a diagrammatic perspective view of the present invention being utilized to effect an automobile repair.

| | |
|---|---|
| 10 | ratcheting adjustable wrench of the present invention |
| 12 | automobile |
| 14 | bicycle |
| 16 | head |
| 18 | fixed jaw on head 16 |
| 20 | fork on head 16 |
| 22 | seat in fork 20 on head 16 |
| 24 | laterally extending opening in head 16 |
| 26 | longitudinally extending slot in head 16 |
| 28 | movable jaw |
| 30 | rack on movable jaw 28 |
| 32 | plurality of teeth on rack 30 on movable jaw 28 |
| 34 | thumb wheel |
| 36 | adjustable worm gear on thumb wheel 34 |
| 38 | shaft on thumb wheel 34 |
| 40 | enlarged base of shaft 38 on thumb wheel 34 |
| 42 | handle |
| 43 | first pivot pin |
| 44 | upper longitudinal projection formed on front upper edge 46 of handle 42 |
| 46 | front upper edge of handle 42 |
| 48 | lower longitudinal projection formed on opposite front lower edge 50 of handle 42 |
| 50 | opposite front lower edge of handle 42 |
| 52 | cam component |
| 54 | second pivot pin |
| 56 | forward seat in forwardmost upper end 57 of cam component 52 |
| 57 | forwardmost upper end of cam component 52 |
| 58 | intermediate seat in intermediate upper point 59 of cam component 52 |
| 59 | intermediate upper point of cam component 52 |
| 60 | rear seat in rearmost upper end 61 of cam component 52 |
| 61 | rearmost upper end of cam component 52 |
| 62 | spring |
| 64 | one leg of spring 62 |
| 66 | other leg of spring 62 |
| 68 | nut |
| 70 | clockwise direction |
| 71 | opposite counterclockwise direction |

DETAILED DESCRIPTION OF THE PREFERRED EMBODIMENT

Figure 2:
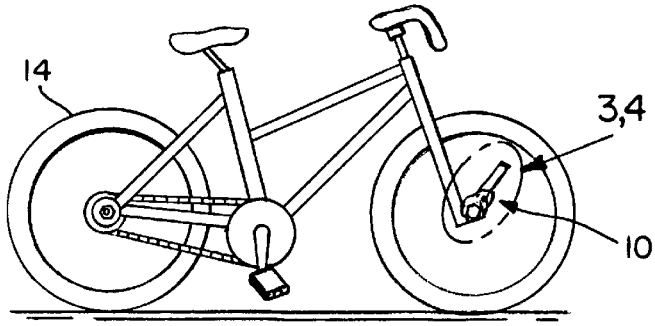
FIG. 2 is a diagrammatic perspective view of the present invention being utilized to effect a bicycle repair.

Referring now to the figures in which like numerals indicate like parts, and particularly to FIGS. 1 and 2, the ratcheting adjustable wrench of the present invention is shown generally at 10 being utilized to effect a repair on an automobile 12 and a repair on a bicycle 14, respectively.

The configuration of the ratcheting adjustable wrench 10 can best be seen in FIGS. 3–7, and as such will be discussed with reference thereto.

The ratcheting adjustable wrench 10 includes a head 16 that has a fixed jaw 18 that extends from one side thereof, a fork 20 in an opposite side thereof with a seat 22 therein, a laterally extending opening 24 that is disposed between the fixed jaw 18 on the head 16 and the seat 22 in the fork 20 of the head 16, a longitudinally extending slot 26 that is disposed between the fixed jaw 18 of the head 16 and the laterally extending opening 24 in the head 16.

The ratcheting adjustable wrench 10 further includes a movable jaw 28 that has a rack 30 with a plurality of teeth 32 thereon. The movable jaw 28 is slidably received in the longitudinally extending slot 26 in the head 16, with the plurality of teeth 32 of the rack 30 of the movable jaw 28 extending into the laterally extending opening 24 in the head 16.

The ratcheting adjustable wrench 10 further includes a thumb wheel 34 that has an adjustable worm gear 36 thereon and a shaft 38 that has an enlarged base 40. The thumb wheel 34 fits onto the shaft 38, with the thumb wheel 34 being rotatively received in the laterally extending opening 24 in the head 16, and with the worm gear 36 engaging the rack teeth 32 of the rack 30 on the movable jaw 28 so as to allow the movable jaw 28 to adjust relative to the fixed jaw 18.

The ratcheting adjustable wrench 10 further includes a handle 42 that is pivotally mounted in the fork 20 of the head 16, by a first pivot pin 43, and has an upper longitudinal projection 44 formed on a front upper edge 46 thereof, and a lower longitudinal projection 48 formed on an opposite front lower edge 50 thereof.

The ratcheting adjustable wrench 10 further includes a cam component 52 that is pivotally mounted in the fork 20 of the head 16 below the handle 42, by a second pivot pin 54, and has a forward seat 56 on a forwardmost upper end 57 thereof for seating the enlarged base 40 of the shaft 38, an intermediate seat 58 on an intermediate upper point 59 thereof, and a rear seat 60 on a rearmost upper end 61 thereof for seating the lower longitudinal projection 48 of the handle 42.

The ratcheting adjustable wrench 10 further includes a spring 62 mounted on the first pivot pin 43 in the fork 20 of the head 16, with one leg 64 thereof biased against the upper longitudinal projection 44 on the handle 42 and the other leg 66 thereof biased against the intermediate seat 58 in the cam component 52.

This allows the upper longitudinal projection 44 of the handle 42 to be normally biased away from the seat 22 in the fork 20 of the head 16, the rear seat 60 in the cam component 52 to be normally biased against the lower longitudinal projection 48 on the handle 52, and the front seat 56 in the cam component 52 to be normally biased against the enlarged base 40 of the shaft 38.

As shown in FIG. 3, a continuous clamping operation is performed on a nut 68 by rotating the handle 42 in a clockwise direction 70.

Figure 4:
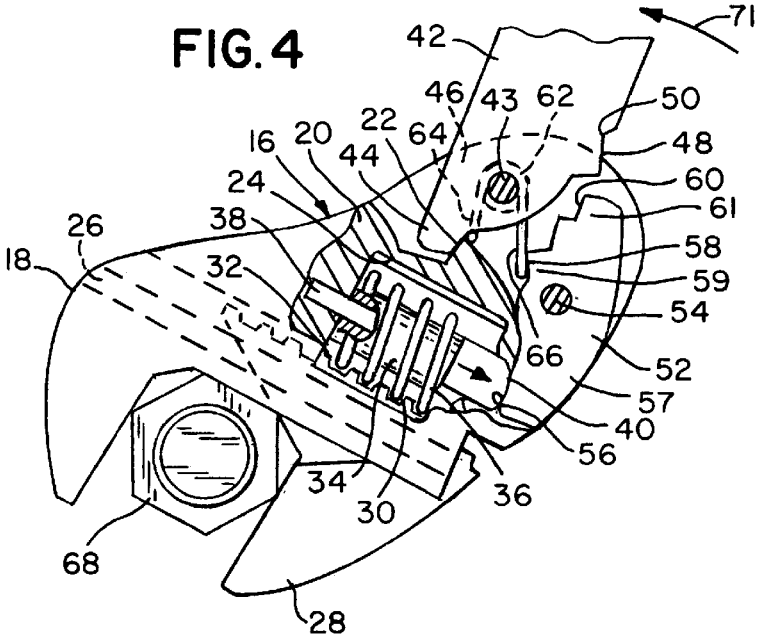
FIG. 4 is a diagrammatic side elevational view, with parts broken away, of the present invention in the area generally enclosed by the dotted ellipse identified by arrow 4 in FIGS. 1 and 2 in the ratcheting position.

As shown in FIG. 4, when the handle 42 is rotated in an opposite counterclockwise direction 71, if the nut 68 offers sufficient resistance, the handle 42 will pivot about the first pivot pin 43 overcoming the spring 62 and allowing the upper longitudinal projection 44 on the handle 42 to engage the seat 22 in the fork 20 of the head 16 and release the lower longitudinal projection 48 on the handle 42 from the rear seat 60 in the cam component 52. This allows the thumb wheel 34 to now slide with the rack 30 on the movable jaw 28 and pivot the cam component 52 against the biasing of the spring 62, thereby allowing a ratcheting action about the nut 68 without having to repeatedly remove the wrench 10 from the nut 68.

It will be understood that each of the elements described above, or two or more together, may also find a useful application in other types of constructions differing from the types described above.

While the invention has been illustrated and described as embodied in a ratcheting adjustable wrench, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A ratcheting adjustable wrench, comprising:

a) a head having a fixed jaw;

b) a movable jaw slidably mounted to said head; and c) a handle pivotally mounted to said head, wherein said fixed jaw extends from one side of said head, wherein said head further has a fork that extends in an opposite side with a seat therein, a laterally extending opening that is disposed between said fixed jaw on said head and said seat in said fork of said head, a longitudinally extending slot that is disposed between said fixed jaw of said head and said laterally extending opening in said head, wherein said movable jaw has a rack with a plurality of teeth thereon, with said movable jaw being slidably received in said longitudinally extending slot in said head, and with said plurality of teeth of said rack of said movable jaw extending into said laterally extending opening in said head; further comprising a thumb wheel that has an adjustable worm gear thereon and a shaft therethrough with an enlarged base, with said thumb wheel fitting onto said shaft, with said thumb wheel being rotatively received in said laterally extending opening in said head, and with said adjustable worm gear engaging said plurality of teeth of said rack on said movable jaw so as to allow said movable jaw to adjust relative to said fixed jaw, wherein said handle is pivotally mounted in said fork of said head, by a first pivot pin, and has an upper longitudinal projection formed on a front upper edge thereof, and a lower longitudinal projection formed on an opposite front lower edge thereof; further comprising a cam component being pivotally mounted in said fork of said head below said handle, by a second pivot pin, and has a forward seat in a forwardmost upper end thereof for seating said enlarged base of said shaft, an intermediate seat in an intermediate upper point thereof, and a rear seat in a rearmost upper end thereof for seating said lower longitudinal projection on said handle.

2. The wrench as defined in claim 1; further comprising a spring mounted on said first pivot pin in said fork of said head, with one leg thereof biased against said upper longitudinal projection on said handle and the other leg thereof biased against said intermediate seat in said cam component so as to allow said upper longitudinal projection on said handle to be normally biased away from said seat in said fork of said head, said rear seat in said cam component to be normally biased against said lower longitudinal projection on said handle, said front seat in said cam component to be normally biased against said enlarged base of said shaft, and thereby provide continuous clamping on a nut when said handle is rotated in a clockwise direction, and when said handle is rotated in an opposite counterclockwise direction and the nut offers sufficient resistance, said handle pivots about said first pivot pin and overcomes said spring and allows said upper longitudinal projection on said handle to engage said seat in said fork of said head and release said lower longitudinal projection on said handle from said rear seat in said cam component, and said thumb wheel to slide with said rack on said movable jaw and pivot said cam component against biasing of said spring, thereby allowing a ratcheting action about the nut without having to repeatedly remove said ratcheting adjustable wrench from the nut.

* * * * *